US011118359B2

(12) United States Patent
Colom Tallo

(10) Patent No.: US 11,118,359 B2
(45) Date of Patent: Sep. 14, 2021

(54) CONSTRUCTION SYSTEM FOR WALL CLADDING

(71) Applicant: Jaume Colom Tallo, Igualada (ES)

(72) Inventor: Jaume Colom Tallo, Igualada (ES)

( * ) Notice: Subject to any disclaimer, the term of this patent is extended or adjusted under 35 U.S.C. 154(b) by 0 days.

(21) Appl. No.: 16/620,273

(22) PCT Filed: May 24, 2018

(86) PCT No.: PCT/ES2018/070374
§ 371 (c)(1),
(2) Date: Dec. 6, 2019

(87) PCT Pub. No.: WO2018/224710
PCT Pub. Date: Dec. 13, 2018

(65) Prior Publication Data

US 2020/0199884 A1 Jun. 25, 2020

(30) Foreign Application Priority Data

Jun. 7, 2017 (EP) ..... 17382341
Jan. 31, 2018 (ES) ..... ES201830122U

(51) Int. Cl.
*E04F 13/08* (2006.01)
*E04F 13/00* (2006.01)

(52) U.S. Cl.
CPC ..... *E04F 13/0832* (2013.01); *E04F 2203/04* (2013.01)

(58) Field of Classification Search
CPC .. E04F 13/0832; E04F 13/081; E04F 2203/04
(Continued)

(56) References Cited

U.S. PATENT DOCUMENTS 2,312,673 A * 3/1943 Rizzolo ..... E04F 13/0842 52/506.08
2,895,702 A * 7/1959 Pierce ..... B60N 3/102 248/285.1

(Continued)

FOREIGN PATENT DOCUMENTS

DE 35 39 565 A1 5/1987
DE 298 07 808 U1 8/1998

(Continued)

OTHER PUBLICATIONS

International Search Report for PCT/ES2018/070374 dated Sep. 26, 2018 [PCT/ISA/210].

(Continued)

*Primary Examiner* — Brian D Mattei
*Assistant Examiner* — Joseph J. Sadlon
(74) *Attorney, Agent, or Firm* — Sughrue Mion, PLLC

(57) ABSTRACT

A construction system (1) for wall cladding having uprights (2) and cross-members (3) to be held between two uprights not aligned vertically, in which the cross-members (3) have two opposing terminals (33) of a deformable material with two bends. The uprights (2) have an anchor (22) where terminals (33) of the cross-members can be attached, with the anchor, for this purpose, having, for each terminal (33), at least two entry parts (A, B) arranged spatially to maintain the relationship with the two bends (a, b) of the terminal, with each bend insertable into one of the entry parts, first requiring elastically deforming one terminal (33) or the upright such that the bends are pressed against the entry parts. The system can be completed with a series of cladding pieces (10) prepared to be suspended from one or more cross-members (3) at the same time.

14 Claims, 7 Drawing Sheets

(58) Field of Classification Search
USPC ..... 52/762
See application file for complete search history.

(56) References Cited

U.S. PATENT DOCUMENTS 3,456,970 A * 7/1969 Sunasky ..... A47B 57/402 403/319
4,034,535 A * 7/1977 Dustmann ..... E04F 13/0814 52/834
4,095,385 A * 6/1978 Brugman ..... E04B 9/247 52/506.08
4,373,314 A * 2/1983 Allan ..... E04B 1/4178 52/379
4,448,006 A * 5/1984 Worley ..... E04B 9/26 52/506.07
4,541,219 A * 9/1985 Parker ..... E04F 13/0837 403/231
4,624,088 A * 11/1986 Arent ..... E04B 9/001 52/506.07
5,063,721 A * 11/1991 Larsson ..... E04F 13/0805 52/379
5,118,069 A * 6/1992 Muhlethaler ..... E04B 9/18 248/613
6,170,214 B1 * 1/2001 Treister ..... E04F 13/0808 52/235
7,010,894 B1 * 3/2006 Cappelle ..... E04B 9/26 52/384
7,111,435 B2 * 9/2006 Flores ..... E04F 21/04 33/526
7,909,297 B1 * 3/2011 Harris ..... E04B 9/225 248/222.11
9,187,897 B1 * 11/2015 Bergman ..... E04B 9/26
9,976,311 B2 * 5/2018 Gulnick ..... F16M 13/02
10,024,068 B1 * 7/2018 Chen ..... E04F 21/0092
10,094,105 B2 * 10/2018 Harnish ..... E04F 13/083
10,321,787 B2 * 6/2019 White ..... E04F 13/09
10,689,859 B2 * 6/2020 Duranleau ..... E04F 13/083

FOREIGN PATENT DOCUMENTS

EP 1 560 991 8/2005
GB 1 500 204 A 2/1978
WO 2006/134182 A1 12/2006

OTHER PUBLICATIONS

Written Opinion for PCT/ES2018/070374 dated Sep. 26, 2018 [PCT/ISA/237].
European Search Report for EP17382341 dated Oct. 10, 2017.

* cited by examiner

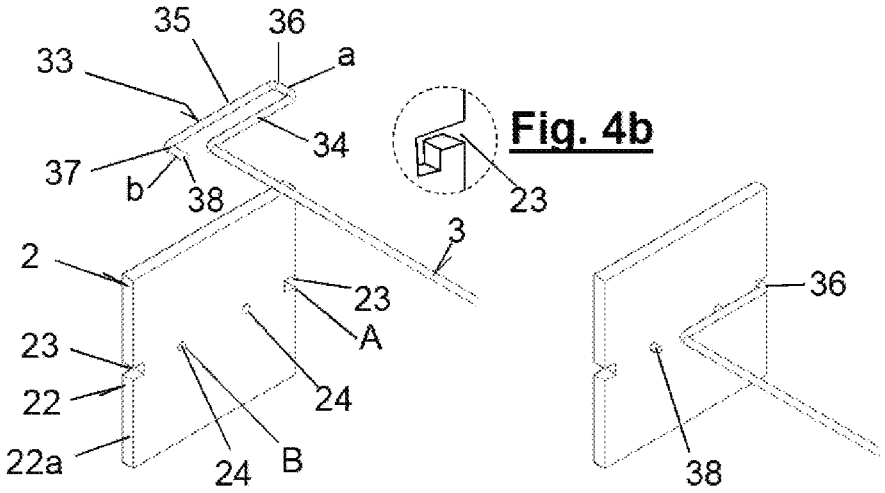
Fig. 4b
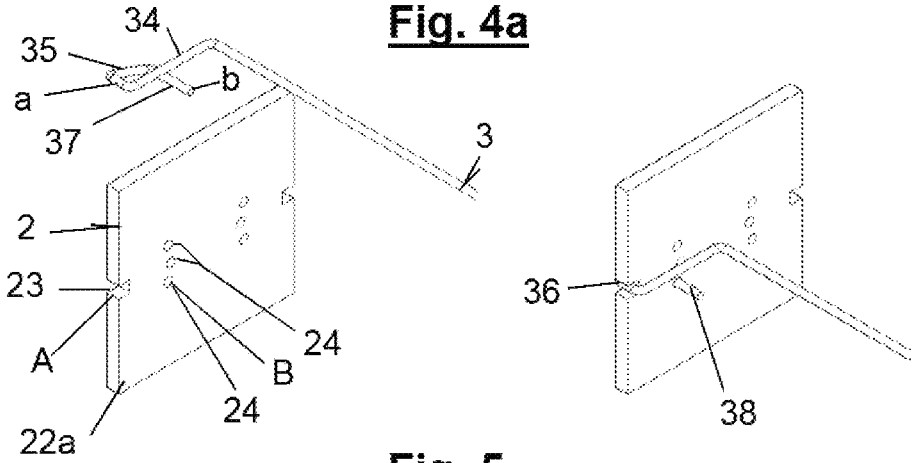
Fig. 4a
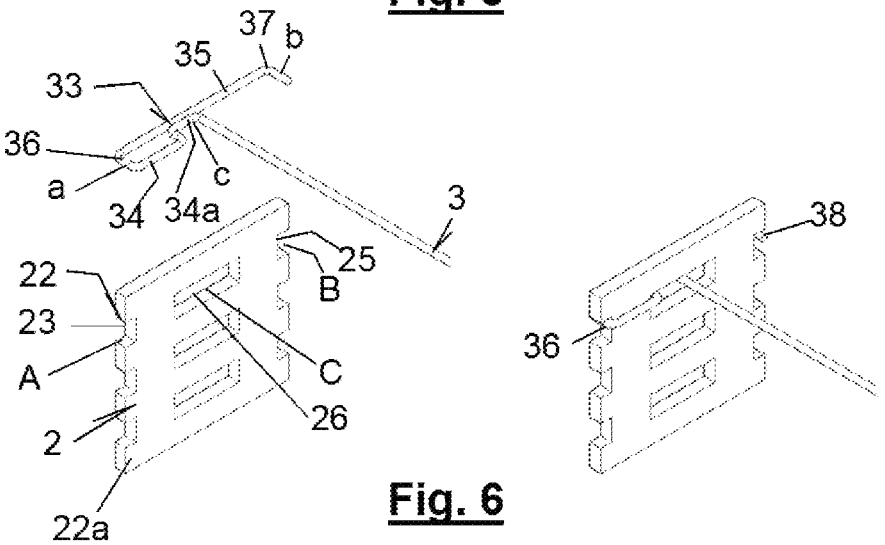
Fig. 5
Fig. 6

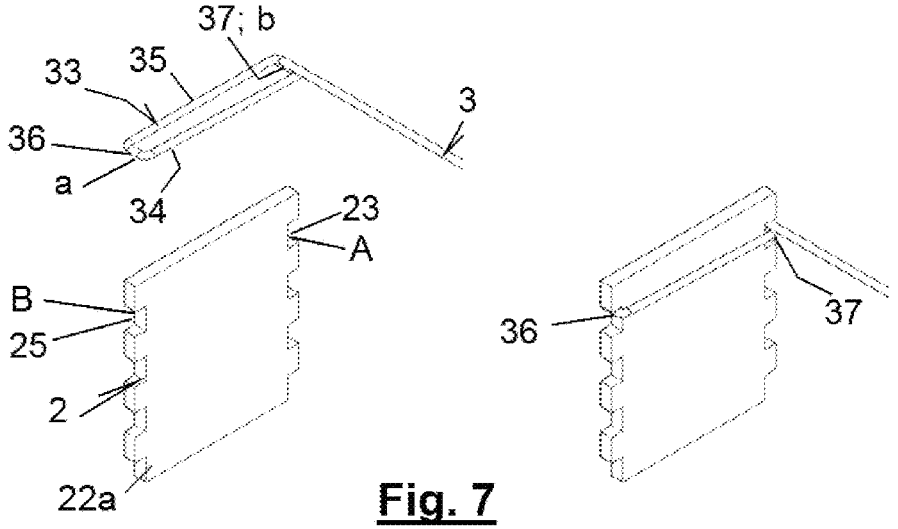
Fig. 7
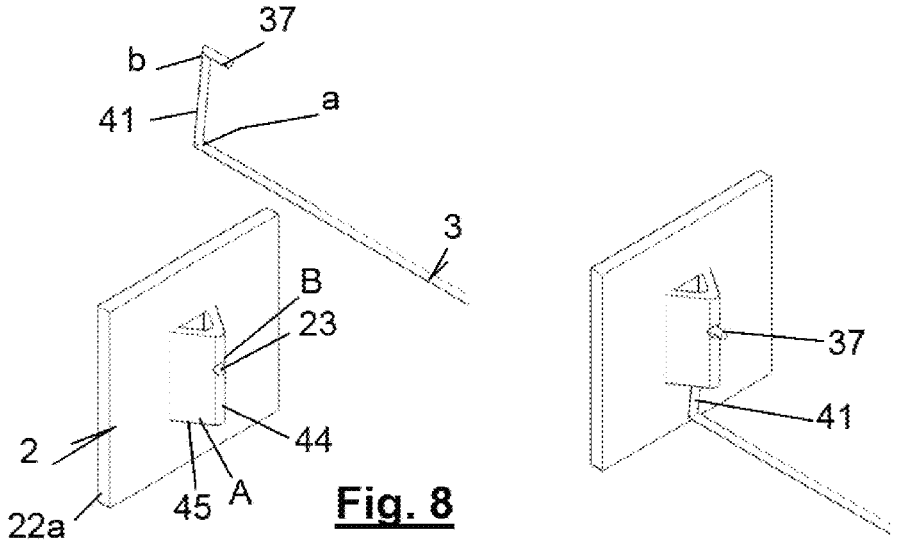
Fig. 8
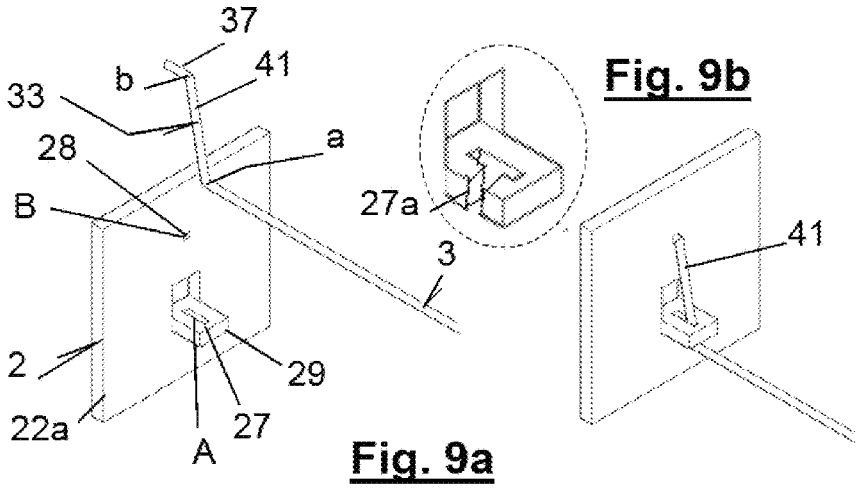
Fig. 9b
Fig. 9a

CONSTRUCTION SYSTEM FOR WALL CLADDING

CROSS REFERENCE TO RELATED APPLICATIONS

This application is a National Stage of International Application No. PCT/ES2018/070374 filed May 24, 2018, claiming priority based on European Patent Application No. 17382341.0 filed Jun. 7, 2017 and Spanish Patent Application No. U 201830122 filed Jan. 31, 2018.

TECHNICAL SECTOR OF THE INVENTION

The invention relates to a construction system for wall cladding, suitable, for example for curtain walls or ventilated façades, which comprises a series of uprights and a series of cross-members intended to be supported between two uprights that are not aligned vertically. The system can be completed by a series of prepared cladding pieces to be attached to one or more cross-members at the same time.

BACKGROUND OF THE INVENTION

There are many known proposals in the area of construction solutions for the installation of curtain walls or ventilated façades. The most common are based on systems that comprise wall anchor elements to which systems for connecting cladding pieces can be attached. These coupling systems may be secured individually to a piece, or they may be designed to cooperate to hold more than one piece, especially when they have a parallelepiped arrangement.

Patent WO2006134182, for example, describes an fastening system for a ventilated façade comprising a set of profiles adapted to be connected to the main façade of the building and multiple fastening elements adapted to secure the cladding pieces to the profiles. One aspect that is of interest in this proposal is that the profiles are configured as guides into which the free terminal of the connection elements can be inserted. These connection elements have a protruding tab oriented vertically that can be inserted into a slot created for this purpose in the corresponding support pieces of the cladding pieces. These support pieces comprise a series of protrusions that are inserted into a series of lateral openings in the cladding pieces.

The solution described in WO2006134182 is of interest because it does not require screws or similar hardware, at least to mount the support pieces on the connection elements or to couple the cladding pieces to the support pieces.

Dispensing with anchoring by screws or similar hardware, facilitates the installation of the ventilated façade, and consequently installation costs are lower, in addition to facilitating the future replacement of cladding pieces, for example, for maintenance or replacement due to breakage or wear.

In this sense, there are other known proposals that seek ways of anchoring cladding pieces to a structure fixed to a wall easily and without the need for auxiliary components.

Patent EP1560991 describes, for example, an anchor element for linking structures, such as, for example, the cross-pieces between stanchions for the construction of ventilated or unventilated façades, which is made up of a resilient leaf spring in the form of a plate with a transversal base with hooking slots that form the hook points and connection points with the stanchions. The anchor elements can be configured in different ways, but always taking advantage of the return force that is generated when it deforms, for example, when a cladding piece is inserted between the plate and the stanchion on which the plate is hooked.

The combination of uprights or stanchions with cross pieces that extend transversally to the uprights to form a sort of mesh on which the support elements for the cladding pieces are secured, and which may be arranged in rows and columns is also known. In some known cases, the same crossbars are used to receive the direct support or to directly support the cladding pieces, although with the help of auxiliary elements in the form of clips or similar elements. One example is described in patent DE 29807808. One of the drawbacks of this type of system is that the replacement of cladding pieces is not practical, because this requires the removal of the associated cross pieces, which extend unbroken between more than one pair of uprights, thus requiring the removal of all of the pieces in the same row.

One of the objectives of the present invention is to provide an alternative to the known systems that allows simple installation at the worksite. For example, one aspect of interest is that the system does not require screws or similar hardware to attach or mount the cladding pieces on a support structure, and that in turn, said support structure also does not require screws or similar hardware to link its components. Such fastening between the components of the structure should be sufficiently firm or secure to allow pre-assembly at the factory and for example, to transport the pre-assembled structure to a worksite.

EXPLANATION OF THE INVENTION

The system of the invention is a construction system for wall cladding that comprises a series of uprights; a series of cross-members intended to be supported between two uprights that are not aligned vertically; and optionally, a series of cladding pieces prepared to be suspended from one or more cross-members at the same time. Said system is characterized in that the cross-members are elongated and have two opposing terminals that are filiform or shaped to generate elastic force, made of an elastically-deformable material and with at least two bends, and in that the uprights are equipped with anchor means in which the terminals of the cross-members can be secured by restoring force, with these anchor means, for this purpose, comprising, for each terminal, at least two entry parts, in the form of slots or openings, arranged spatially to maintain the relationship with the bends of the terminal, with each one of the at least two bends able to be inserted simultaneously into one of said entry parts, first requiring that said terminal, said upright or both the terminal and the upright be elastically deformed such that said bends are pressed tightly against said entry parts by elastic reaction.

Advantageously, the system described in the invention can be assembled and disassembled by sections; in other words, a cross-member can be removed and reinstalled at any time, not necessarily in the same position, which is not possible in the case of steel mesh construction systems that form a grid of two or more columns and that are formed by warps running the entire length of the mesh and segments covering the entire width of the mesh, which makes it impossible to disassemble a single lattice.

In the system of the invention, a single cladding piece can be replaced or assembled without affecting the other pieces. Likewise, as will be explained in greater detail below, it is possible to arrange the cross-members and/or, when applicable, cladding pieces, following patterns that are not necessarily in rows and columns, due to the fact that the system allows the cross-members to be extended between every two selected parallel uprights, with the possibility of disassembling them simply and without requiring auxiliary fastening elements such as screws or similar hardware. The system of the invention thus allows forming a kind of mesh with different grids, combining areas with a higher density of cross-members and/or cladding pieces with areas with lower densities, making it possible, for example, to adjust the percentage of light or incident sunlight through the system, when applicable, through the ventilated façade or curtain wall.

It is to be noted that the cross-members are firmly attached or held to the uprights by restoring force generated by elastically deforming at least one of the uprights or the terminal ends of the cross-members during the coupling thereof.

This construction system has a large number of applications in the construction and decoration sector, for outdoor or indoor cladding, in either dry or wet applications, and is of special interest for building envelopes.

The cross-members may be made of one piece.

In one variant of the invention, the anchor means are formed in a sheet of cut or stamped steel or plastic material according to the required design to determine in them the entry parts where the terminal ends of the cross-members can be attached.

For example, with the first entry part can be formed by a slot cut arranged in a first edge of the sheet, and the second entry part formed by an opening passing through said sheet, or by an auxiliary slot arranged in the edge opposite the first edge of the sheet.

Advantageously, the uprights can be supplied on rolls, which facilitates pre-assembly of the uprights and cross-members at the factory, because it is easy to cut them to the required length, as well as stamping them or perforating them at convenience to form the anchor means, in this case in the form of slots or openings.

The system of the invention may be extremely lightweight. To implement the system, for example, sheets with thicknesses on the order of 1 mm may be used and combined with cross-members 1 mm in diameter.

The invention considers that at least one of the slots and the auxiliary slot, if any, are not straight slots, which could favor locking the terminal attached to the sheet in position, as illustrated in detail in FIG. 4*b*.

In an variant of interest, in combination with the anchor means described above, the terminal is bent back onto itself, forming a U-shaped frame with an interior branch, an exterior branch, and a connecting bridge; and an anchoring end, where the terminal tip is located, angled with respect to the exterior branch of the frame, allowing the terminal to be attached to the sheet by arranging the connecting bridge into the slot, with the interior and exterior branches holding the sheet, one on each side, and with the terminal tip in turn inserted into the opening or, in such case, the auxiliary slot.

Preferably, according to this variant of interest, the sheet is oriented perpendicular to the direction in which the cross-member extends and the frame is also oriented perpendicular to the direction of extension of the cross-member.

In another variant, in which the second entry part of the anchor means is an opening that passes through the sheet, the exterior branch of the anchor frame is shorter than the interior branch; and the length of the tip of the anchor is such that it passes through the sheet and can provide support for the interior branch of the frame.

In another variant, in which the second entry part of the anchor means is the aforementioned auxiliary slot, the sheet is provided with an adjustment window and the interior branch of the frame with a bend that engages into the adjustment window.

According to another embodiment, the anchor means comprise a sheet, the first and second entry parts being formed by anchor through holes.

In a variant of this embodiment, the terminal is bent back onto itself, forming at least two bends that correspond to said anchor through holes, said the terminal being able to be aligned on the sheet through the anchor through holes.

The anchor through holes are not necessarily coplanar.

In this regard, the invention considers, for example, that the sheet is oriented perpendicular to the direction of extension of the cross-member and comprises a tab that extends in the direction of the cross-member and in which one of the anchor through holes is formed; with the terminal bent back onto itself in a first bend that guides a first section of the terminal for insertion into the anchor opening, and a second bend that creates an anchoring end, wherein the terminal tip is positioned, at an angle with the first section of the terminal, and able to be inserted into the second anchor through hole.

It may be of interest for the anchor through hole to extend to the edge of the sheet, offering lateral access for the insertion of the terminal.

In another alternative embodiment, the anchor means comprise a sheet, the first and second entry parts being formed by the opposing edges of a through slot formed in said sheet; and the terminal is bent back onto itself, determining a sort of spring with two branches, one interior and one exterior, a connecting bridge, each branch being provided with an anti-return bend oriented in the direction of the opposite branch, each intended to engage through restoring force in one edge of the through slot, requiring the compression of the spring to do this, bringing the branches closer together and inserting the bridge into the through slot.

BRIEF DESCRIPTION OF THE DRAWINGS

FIG. 4*a* to FIG. 11 schematically show some of the embodiments considered in the invention, especially for attaching the terminals of the cross-members into the corresponding anchor means on uprights, with each figure illustrating a terminal and anchor means pair in the position prior to engagement and in engagement position, respectively;

DETAILED DESCRIPTION OF THE INVENTION

Figure 1:
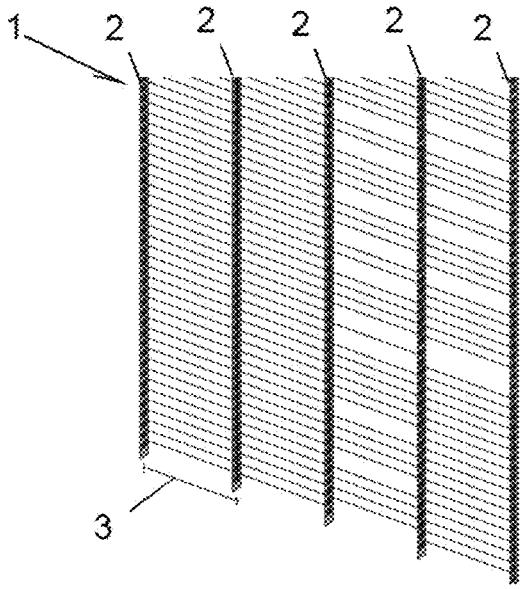
FIG. 1 shows a schematic view of an example of a system according to the invention, with the cladding pieces removed to show a possible organization of the uprights and cross-members, noting that this organization does not necessary have to be identical between each pair of adjacent parallel uprights.
Figure 2:
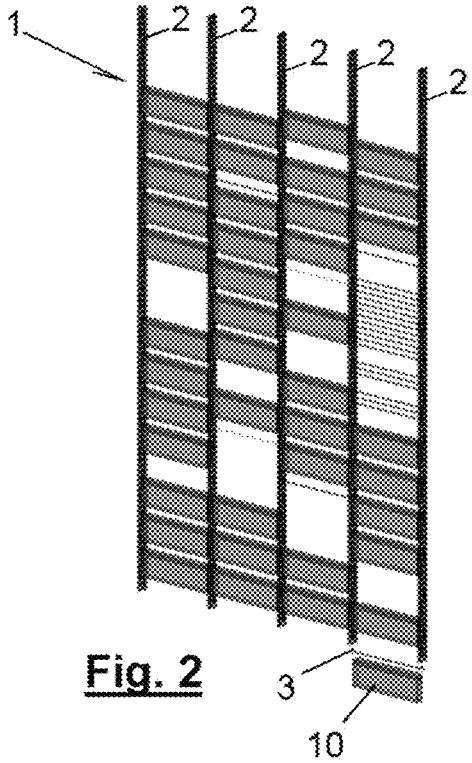
FIG. 2 shows a schematic view of another example of a system according to the invention, in this case, with cladding pieces.
Figure 3:
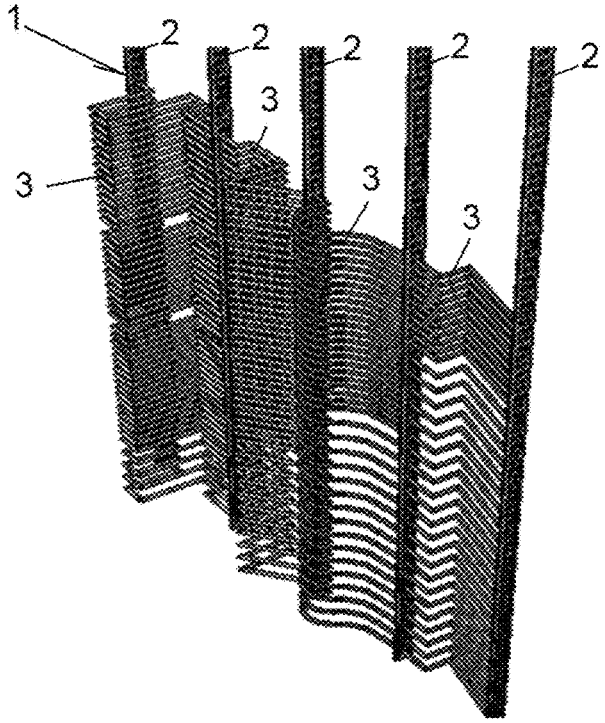
FIG. 3 shows a schematic view of another example of the system according to the invention, with the cladding pieces removed to illustrate that the cross-members may have shapes that are not inscribed within an imaginary plane, giving the system a 3D or three-dimensional configuration.

The construction system of the invention is exemplified in FIGS. 1 to 3 in the form of wall cladding, comprising a series of uprights 2; a series of cross-members 3 intended to be supported between two uprights that are not aligned vertically; and optionally, a series of cladding pieces 10 (shown in FIG. 2) prepared to be suspended from one or more cross-members at the same time.

These FIGS. 1 to 3 are intended to show the versatility of the system being able to form a sort of mesh, which, in addition to being able to present different shapes, allows the installation of cladding pieces 10 not necessary arranged in perfectly aligned rows and columns.

To this end, the uprights, normally arranged vertically, are provided with anchor means distributed along their length where a series of terminals provided on the cross-members 3 can be attached firmly.

The uprights 2 can be fastened to the surface or wall to be cladded using conventional methods. Alternatively, the system may be suspended or hung, depending on the preferred orientation.

FIG. 4*a* to FIG. 10 show options within the scope of the invention in which the uprights 2 have the form of a sheet 22*a* and are essentially arranged perpendicular to the surface to be covered by the system or the plane of the façade in the case of a ventilated façade. Specifically, the uprights 2 may be based on a sheet 22*a* made of cut or die punched steel depending on the required design, to determine anchor means 22 therein to which a series of terminals 33 of the cross-members 3 can be attached. Advantageously, the uprights 2 can be supplied on rolls, which facilitates pre-assembly of the uprights and cross-members at the factory, because it is easy to cut them to the required length, depending on each mesh to be carried out, and punch or perforate as required.

The uprights 2 can also be formed by a concatenation of sheets 22*a*, connected by screws or clips, firmly or jointed, which not only does not prevent pre-assembly of uprights 2 and cross-members 3, but also makes it possible, if desired, to finish the assembly of the uprights at the worksite, using sections prepared at the factory, which are connected at the worksite.

The fact that the uprights 2 are elements that can be disassembled makes it possible to shore the sheets at worksites, which is very useful in cases in which openings need to be made, for example, for windows, after the façade has been installed.

In regard to the terminals 33, or to the cross-members 3 in their entirety if they are one piece, these may be flat bars or have a rounded cross-section. The latter case is shown in the aforementioned FIG. 4*a* to FIG. 10. The cross-members may, for example, be made of iron, stainless steel, aluminum, galvanized steel, or even plastic materials.

In the embodiments shown in FIG. 4*a* to FIG. 10, the anchor means 22 for each terminal 33 of a cross-member comprise various entry parts in the form of slots or openings, spatially arranged to maintain correspondence to the bends formed in the terminal 33, each of the bends being able to grip simultaneously in one of said entry parts such that, by elastic reaction, these bends are held tightly against the entry parts when the terminal attempts to return to its original shape, and all of this such that the terminal 33, as a whole, is secured to the anchor means.

For this purpose, at least one of the uprights 2 and the terminals 33 of the cross-members 3, whether the cross-members 3 are of one piece or of several, have the flexibility to be mutually attached by restoring force. That is to say, in order to arrange the bends of the terminals 33 in the recesses or entry parts, respectively, of the uprights 2, or the uprights 2 must be elastically deformed; or these terminals 33 must deform elastically; or both components (uprights 2 and terminals 33) must deform elastically and then be restrained by restoring force when they tend to adopt their original form again. Advantageously, the connection between uprights 2 and cross-members 3 is not only reversible, but can be carried out without the use of screws or the like.

As will be seen, the spatial distribution of the anchor means 22 and the bends of each terminal 33 that are inserted therein prevents the cross-members 3 from moving in the x, y, and z planes, with respect to the associated uprights 2, once the two terminals 33 have been inserted into the uprights.

In the example in FIG. 4*a* and 4*b*, in the sheet 22*a*, a first entry part A is formed by a slot 23 arranged in a first edge of the sheet 22*a*, and a second entry part B is formed by an opening 24 that passes through the aforementioned sheet 22*a*. Correspondingly, the terminal 33 of the cross-member 3 is bent back onto itself, determining bends a, b that grip the aforementioned entry parts A, B.

More specifically, the terminal 33 is bent to form a U-shaped frame with an interior branch 34, an exterior branch 35, and a connecting bridge 36; and an anchoring end 37, where the terminal tip 38 is located, angled with respect to the exterior branch 35 of the frame, allowing the terminal 33 to be attached to the sheet 22*a* by inserting the connecting bridge 36 into the slot 23, with the interior and exterior branches holding the sheet 22*a*, one on each side, and at the same time, inserting the tip 38 of the terminal 33 into the opening 24, previously requiring that the terminal 33 be elastically deformed to separate the branches of the U-shaped frame and/or the sheet 22*a* be elastically deformed.

Although FIGS. 4*a* and 4*b* (as well as the rest of the examples) show only one part of the sheet 22*a*, it is clear that the sheet extends upwards and downwards, being provided with anchor means 22 similar to those shown distributed along the entire length thereof.

Note that the sheet 22*a* in the example is symmetrical and that it is essentially provided with two slots 23 and two openings 24 at the same level, which allow another terminal from another cross-member, not shown, to be attached to the same sheet 22*a*, with this other cross-member extending from the opposite side of the sheet 22*a*.

The example in FIG. 5 is similar to the example in FIGS. 4*a* and 4*b*, although in this case, the exterior branch 35 of the anchor frame is shorter than the interior branch 34 and the length of the anchoring end 37 is such that it passes through the sheet 22*a* such that this anchoring end 37, when passing through the sheet 22*a*, can provide support for the interior branch 34 of the frame, offering greater stability to the system.

It should be noted that the sheet 22*a* may be provided with multiple openings 24 at different levels, associated with a same terminal 33, so that there is no mechanical interference between two terminals 33 anchored at the same level on the sheet 22*a*, such that each one of the two cross-members 3 extend from one of the sides of the sheet 22*a*.

In the example in FIG. 6, the number of supports or contacts between the terminal 33 of a cross-member 3 and the sheet 22*a* of the upright 2 is increased.

In this case, the anchor means 22 for each terminal 33 comprise a number of three entry openings A, B, and C intended to cooperate with an equal number of bends a, b, and c in the terminal 33 in the following manner.

The first, second, and third entry openings A, B, and C formed in the sheet 22*a* are determined by a slot 23 in one edge of the sheet 22*a*; one auxiliary slot 25 in the other edge of the sheet 22*a*; and an adjustment window 26, respectively, formed in the central portion of the sheet 22*a*. In turn, the terminal 33, although it is bent back onto itself, now has a slightly different configuration from those shown in FIGS. 4*a*, 4*b* and 5, again determining a general U-shaped frame with an interior branch 34, an exterior branch 35, and a connecting bridge 36; and an anchoring end 37, wherein the terminal tip 38 is located, at an angle with the exterior branch 35 of the frame. The interior branch 34 of the frame has a bend 34*a* that engages into the adjustment window 26 of the sheet 22*a*.

Therefore, in the anchoring position, the terminal 33 can be attached to the sheet 22*a* by inserting the connecting bridge 36 into the slot 23, with the interior and exterior branches holding the sheet 22*a*, one on each side thereof, inserting the terminal tip 38 into the auxiliary slot 25 and simultaneously engaging the bend 34*a* into the adjustment window 26 of the sheet 22*a*, previously requiring that the terminal 33 be elastically deformed separating the branches of the U-shaped frame and/or elastically deforming the sheet 22*a*.

In the example, the size of the adjustment windows 26 is sufficient to hold or receive the bend 34*a* of two terminals 33, if two terminals 33 are inserted at the same level of the upright 2.

In the embodiment shown in FIG. 7, the anchor means 22 of the sheet 22*a* comprise a first and second entry openings A and B determined by a slot 23 arranged in a first edge of the sheet 22*a*, and an auxiliary slot 25 arranged in the opposite edge of the sheet 22*a*, respectively. Correspondingly, the terminal 33 of the cross-member is bent back onto itself in the form of a spiral to form a U-shaped frame, this time towards the interior of the cross-member 3, with an exterior branch 35, and interior branch 34, and a connecting bridge 36; and an anchoring end 37, where the terminal tip 38 (which is hidden in this view) is located, in this case angled with respect to the interior branch 34 of the frame, allowing the terminal 33 to be attached to the sheet 22*a* by inserting the connecting bridge 36 into the slot 23, with the interior and exterior branches holding the sheet 22*a*, one on each side thereof, and the terminal tip 38 being inserted into the opening 25 at the same time, previously requiring that the terminal 33 be elastically deformed separating the branches of the U-shaped frame and/or elastically deforming the sheet 22*a*.

Unlike the previous embodiments, in the example in FIG. 7, the dimensions of the U-shaped frame are such that they allow the central portion of the cross-member 3 to extend from an area close to one of the edges of the sheet 22*a*, instead of from the central portion of the sheet 22*a*.

Figure 11:
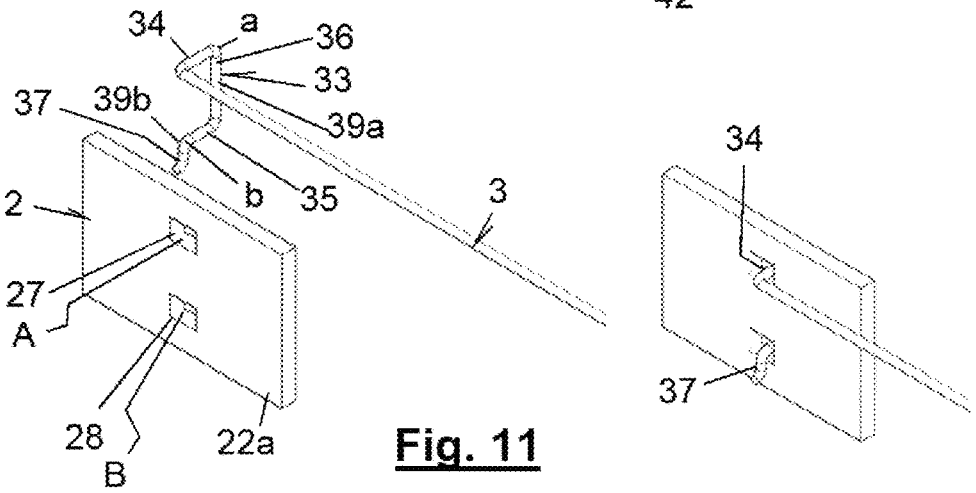

The variant in FIG. 11 is a variant that allows the uprights 2 to be arranged parallel to the surface to be covered, or, if applicable, to the façade.

In this case, the anchor means 22 comprise in the sheet 22*a*, a first and second entry opening A, B, formed by two anchor through holes 27 and 28, respectively. Correspondingly, the terminal 33 is formed in the cross-member 3 oriented essentially perpendicular thereto and bent back onto itself, determining a first and a second bend 39*a*, 39*b* that correspond with the anchor through holes 27 and 28, allowing the terminal 33 to be aligned in the sheet 22*a*, with the second bend also serving as an anti-return element, preventing the anchoring end 37 of the terminal 33 from being removed from the anchor opening 28 into which it was inserted during the attachment of the terminal 33 to the upright 2.

In the example, the first bend 39*a* has a generally U-shaped frame, and the same numerical references used to designate the parts of the previous variations will be used to describe it, distinguishing an upper branch 34, a lower branch 35, and a connecting bridge 36, with a length similar to the distance between the anchor through holes 27 and 28; and the second bend 39*b* ends with an anchoring end 37, where the terminal tip 38 is located. In this case, in order to insert the terminal 33 into the sheet 22*a*, the U-shaped frame must be deformed elastically, this time bringing their upper and lower branches 34 and 35 together, which will then expand, causing the terminal 33 to be secured to the sheet 22*a* by restoring force.

Alternatively or simultaneously it may be necessary to elastically deform sheet 22*a*.

The invention considers that in other embodiments, the anchor through holes are not coplanar, as illustrated, for example, in the embodiments of FIGS. 8 and 9.

In the embodiment in FIG. 9*a*, the sheet 22*a* is oriented perpendicular to the direction of extension of the cross-member 3 and comprises a tab 29 that extends in the direction perpendicular to the sheet 22*a*, in which the first of the anchor through holes 27 is formed; with the terminal 33 bent back onto itself in a first bend a that orients a first section 41 of the terminal 33 precisely for insertion into the aforementioned first anchor through hole 27. A second bend b creates an anchoring end 37 in the terminal 33, where the terminal tip 38 is located, at an angle with the first section 40 of the terminal for insertion into the second anchor opening 28, all as shown in FIGS. 9*a* and 9*b*.

To achieve the coupling position, the terminal 33 must be elastically deformed around the first bend a and the first section 40 of the terminal 33 inserted into the first anchor through hole 27 and/or the sheet 22*a* must be elastically deformed. By elastic reaction of the elastically deformed parts, when the anchoring end 37 is lined up with the second anchor through hole 28, the anchoring end will automatically be held in the second anchor through hole 28.

The invention considers that the first anchor through hole 27 is open to the exterior, for example, by means of a lateral opening 27*a* in the tab 29 through which the first section 40 can be inserted, laterally, into the first anchor through hole 27, as illustrated in the detail of FIG. 9*b*. This lateral opening will preferably be arranged such that the terminal 33 and/or the sheet 22*a* must be elastically deformed to insert the terminal 33 into the first anchor through hole 27. This prevents the terminal 33 from being withdrawn accidentally from the first anchor through hole 27 when it adopts its adjustment position on the sheet 22*a*.

FIG. 8 shows an alternative in which the terminal 33 has two bends to form a sort of hook and the sheet 22*a* has a housing 44, obtained by stamping the sheet 22*a* or formed by an extension welded onto the sheet 22*a*, intended to receive the terminal 33 through an access opening 45 and where the hook can be engaged.

In the specific example, the terminal 33 is bent to form a first bend that is followed by a straight section 41 whose end is also bent to form a second bend b, which is followed by the anchoring end 37 of the terminal 33. In order to achieve the coupling position of the terminal 33 to the sheet 22*a*, it is first necessary to elastically deform the terminal around the first bend towards the exterior and/or the sheet 22*a*, inserting the terminal in the housing 44 and so that by restoring force it will tend to adopt its original shape when the anchoring end 37 is lined up with an anchor opening 23 included for this purpose in the sheet 22*a*, specifically in the front wall of the housing.

It should be noted that the housing 44 has a V-shaped cross-section, such that the first section 40 of the terminal will be supported, self-centered, against the vertex of the V-shaped cross section, thus preventing lateral displacements of the cross-member 33.

Figure 10:
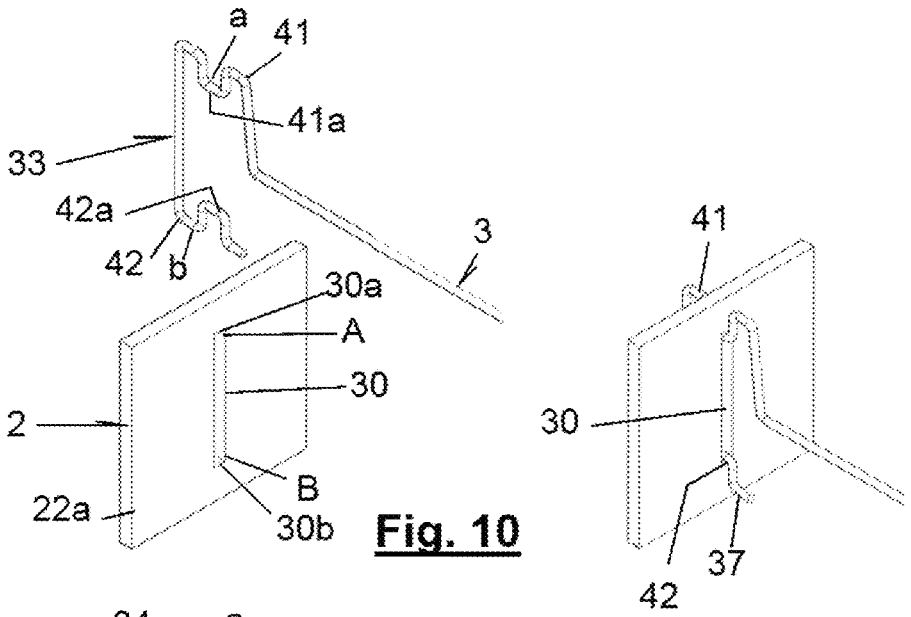

Another possible embodiment is illustrated in FIG. 10. In this case the anchor means 22 comprise in the sheet 22*a*, a first and a second entry opening A, B, formed by the opposing edges 30, 31 of a same through slot 30 formed in said sheet 22*a*. Correspondingly, the terminal 33 is bent back onto itself, creating a sort of spring with two branches, an interior branch 41 and an exterior branch 42, and a connecting bridge 43, with each branch having an anti-return bend 41*a*, 42*a* oriented in the direction of the opposite branch and each intended to fit by restoring force in one corresponding side 30*a* or 30*b* of the through slot 30, requiring elastically deforming the sheet 22*a* and/or the compression of the spring, bringing the branches closer together and inserting the bridge into the through slot 30 in the sheet 22*a*. The sheet 22*a* and/or the spring will tend to expand, i.e., recover its original shape, fitting the spring snugly in the through slot 30.

Figure 12:
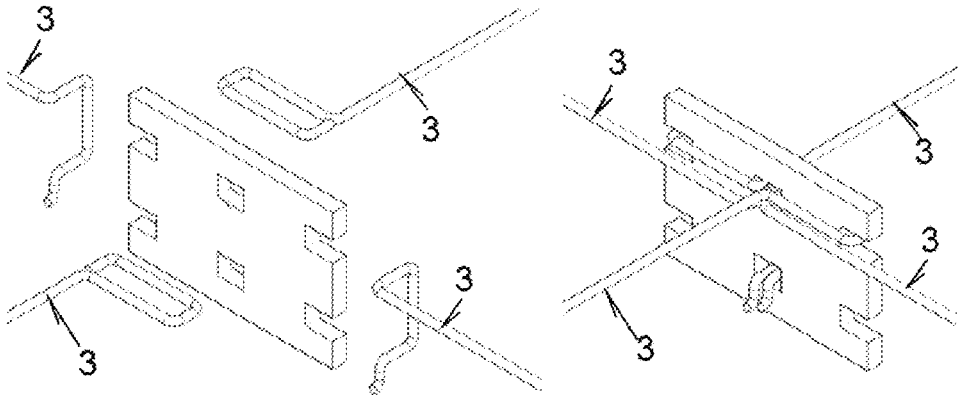
FIG. 12 shows a schematic view of a particular embodiment of the invention, which exemplifies how the system in the invention is also suitable for forming junctions between cross-members to form three-dimensional constructions.

FIG. 12 is an example that shows a schematic view of how a same sheet 22*a* can be prepared so that multiple terminals 33 from the respective cross-members 3 can simultaneously be attached therein. This example shows the sheet 22*a* of an upright 2 with slots and openings so that four terminals 33 of four cross-members 3 can be attached to it at the same level, with the sheet 22*a* determining a sort of junction from which the four cross-members 3 project orthogonally with respect to each other, with two of these in opposing positions attached to the sheet 22*a* using a solution similar to that illustrated in FIGS. 4*a* and 4*b*; and the other two cross-members 3, also in opposing positions, are attached to the sheet 22*a* using a solution similar to that illustrated in FIG. 11.

Figure 13:
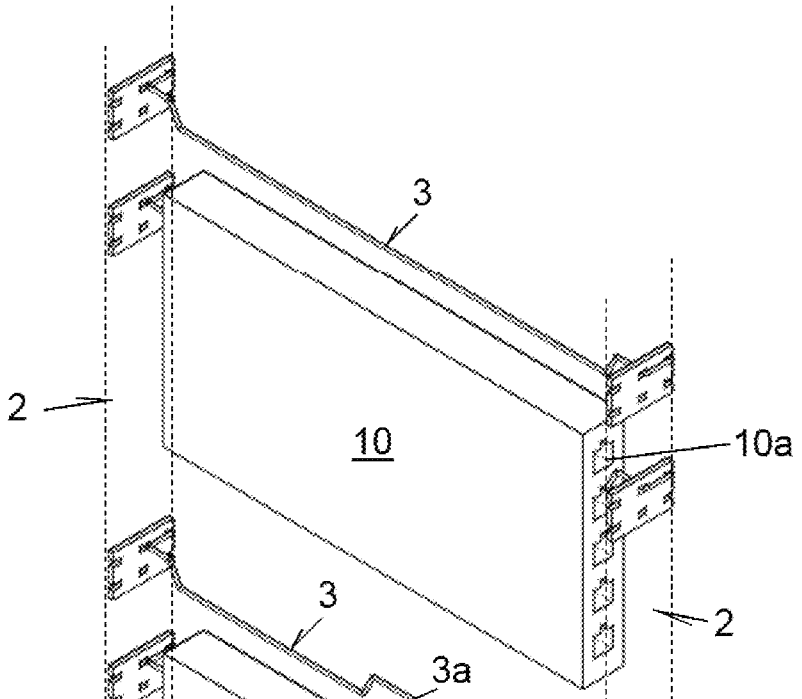
FIGS. 13 to 15 show several alternatives for the suspension of cladding pieces on the cross-members of systems according to the invention.
Figure 14:
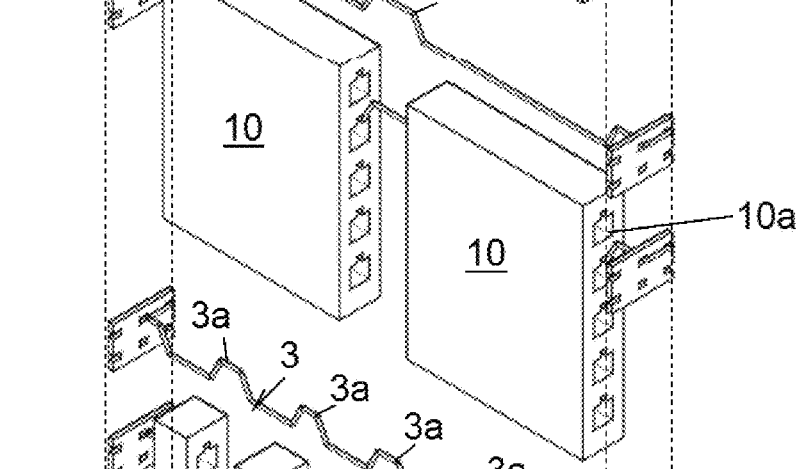
Figure 15:
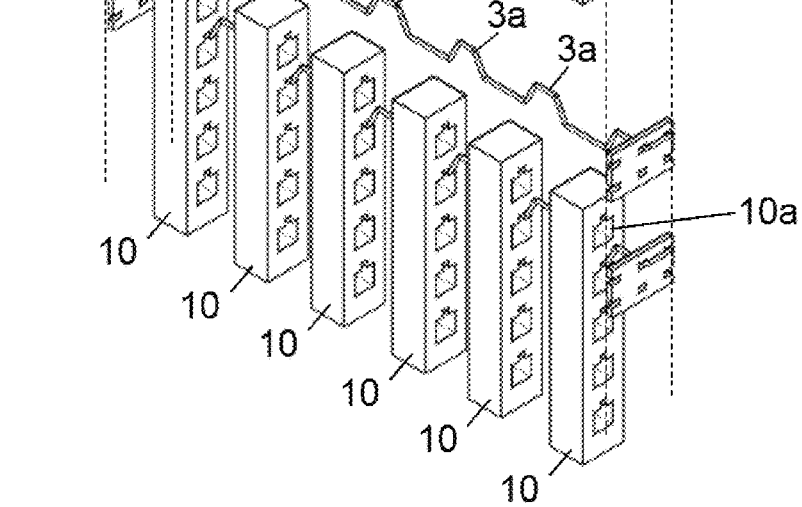

FIGS. 13 to 15 show some of the options that the system of the invention allows for supporting the cladding pieces 10.

While the cross-member between the terminals 33 may be straight, as shown in FIG. 13, the invention considers that this is not so and that the cross-member 3 may be curved, recessed, spiral, etc., so that the façade can acquire relief or volume inwards, outwards, or both.

The cross-members 3 are suitable for suspending cladding pieces 10, which may be of different shapes, such as bricks, ribbed tubes, circular wires, etc. preferably equipped with one or more through holes 10*a* or grooves for insertion of the corresponding cross-members 3.

As shown, one or more cross-members 3 may pass through each piece 10 at a time.

FIGS. 14 and 15 show that the design of the cross-members, while allowing them to be coupled or fastened to two uprights 2 by their terminals 33, it also allows the suspended piece or pieces 10 to be positioned, limiting the lateral movement of the piece or pieces 10 so that they cannot shift towards the terminals 33. This could be achieved by making cross-members 3 with curves 3*a* or protrusions.

The pieces 10 may be made of any material, depending on the mechanical characteristics that are desired. The pieces 10 may simply be embellishments, with no structural function or load at all. For example, the invention considers that the pieces 10 may be made of steel, plastic, glass, ceramic, stoneware, wood, composites, etc. or any of their multiple types of finish.

When a single cross-member 3 passes through the pieces 10, the wind resistance of the completed system is reduced, because when the wind blows, the pieces 10 have the capacity to move, rotating around the cross-member 3 if it has a circular or at least rounded cross-section.

Figure 16:
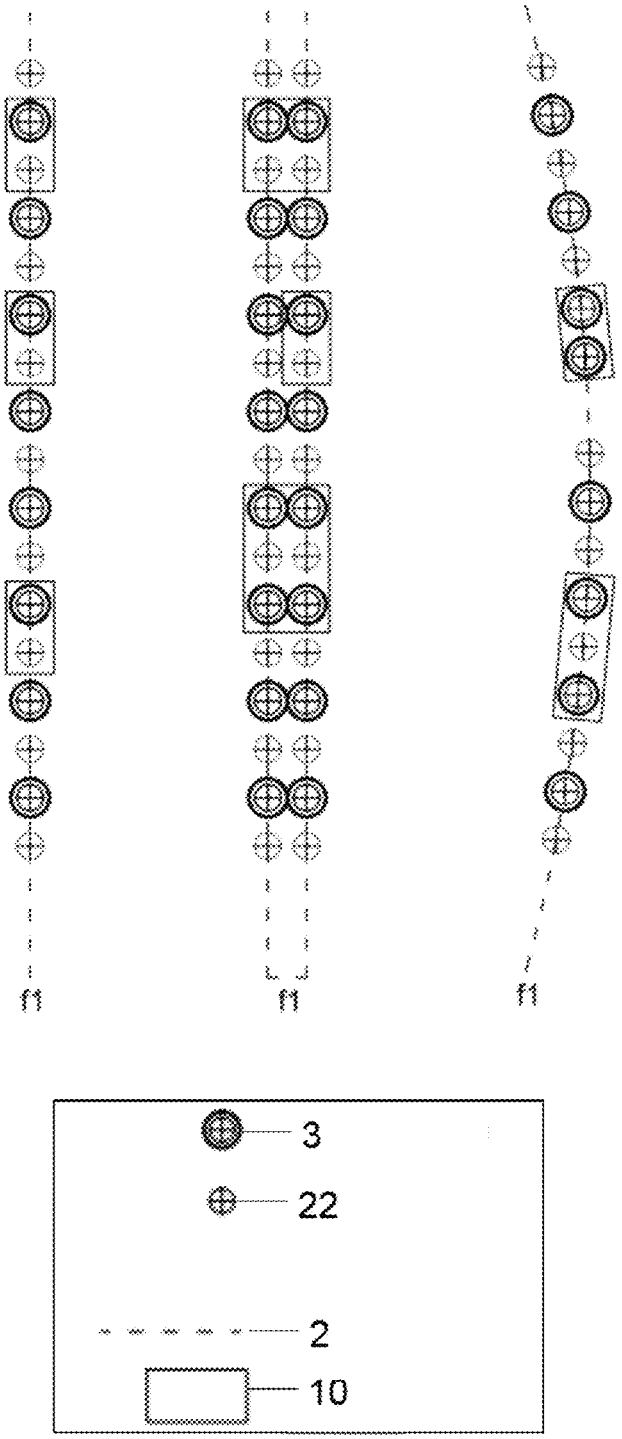
FIGS. 16 and 17 schematically show the versatility of the system according to the invention, illustrating different construction systems, taking advantage of the modular nature of the system.

The system according to the invention is extremely versatile as shown in FIG. 16. This FIG. 16 shows different variants of the system in a drawing and lateral elevation. In example 1, the uprights 2 are straight and vertical and the cross-members 3 are distributed uniformly and are equidistant, illustrating some pieces 10, with a single cross-members 3 passing through each one; in example 2, the uprights 2 are installed in pairs and although the cross-members 3 in this case are distributed uniformly and are equidistant, coinciding on the same level on the two uprights 2, the illustration shows pieces 10 through which a single cross-member 3 passes, but also pieces 10 through which two cross-members 3 pass on the same level; in example 3, the uprights 2 are not vertical, but rather form a curved line in order to, for example, give volume to the ventilated façade, and in addition, the cross-members 3 are not only not equidistant between the uprights 2 but also show two pieces 10 suspended from two cross-members 3 at a different level which in the two pieces 10 are positioned at different distances from each other.

Figure 17:
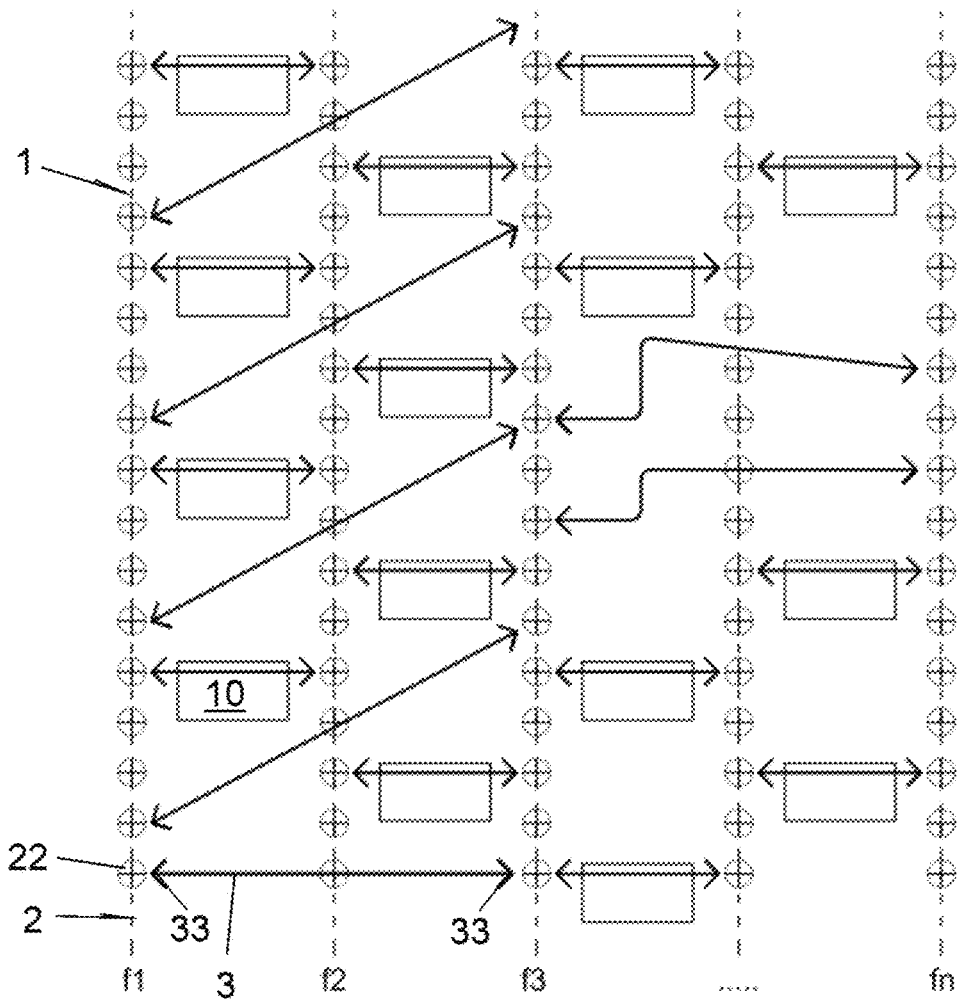

Lastly, FIG. 17 shows a schematic view and a front elevation view of another possibility within the scope of the invention. In this case, the system represented combines cross-members 3 that extend between two adjacent uprights 2 with cross-members 3 that extend between two non-adjacent uprights, the terminals 33 of which are also not necessarily attached to anchor means 22 arranged on the same level on the aforementioned uprights 2.

The invention claimed is:

1. A construction system (1) for wall cladding, comprising a series of uprights (2) and a series of cross-members (3) configured to be supported between two uprights that are not aligned vertically, wherein:

each of the cross-members (3) is elongated and has two opposing terminals (33) filiform or shaped to generate elastic force, made of an elastically deformable material and bent back onto itself to form at least two bends, and the uprights (2) are equipped with anchor means (22) in which the terminals (33) of the cross-members can be secured by restoring force, said anchor means comprising, for each terminal (33), at least two entry parts (A, B), in the form of slots or openings, spatially arranged in relation to the at least two bends (a, b) of the terminal, each one of the at least two bends configured to be inserted simultaneously into one of the entry parts, first requiring that said terminal (33), said upright (2) or both the terminal and the upright, be elastically deformed so that said bends are pressed tightly against said entry parts through elastic reaction; and wherein each cross-member is a one-piece construction that includes the opposing terminals, wherein the opposing terminals form opposite ends of the cross-member; and wherein each cross-member and the corresponding opposing terminals form an integral one-piece construction, wherein the opposing terminals form integral opposite ends of the cross-member.

2. The construction system (1) according to claim 1, comprising a series of cladding pieces (10) prepared to be suspended from one or more of the cross-members (3) at the same time.

3. The construction system (1) according to claim 1, wherein the anchor means (22) are formed in a sheet (22*a*), the first entry part (A) being formed by a slot (23) arranged in a first edge of the sheet, and the second entry part (B) formed by an opening (24) passing through said sheet, or by an auxiliary slot (25) arranged in the edge opposite the first edge of the sheet.

4. The construction system (1) according to claim 3, wherein at least one of the slots (23) and the auxiliary slot (25), if any, are not straight slots.

5. The construction system (1) according to claim 3, wherein the terminal (33), which is bent back onto itself, forms, a generally U-shaped frame with an interior branch (34), exterior branch (35), and a connecting bridge (36); and an anchoring end (37) terminating in a terminal tip (38), the anchoring end extending at an angle with respect to the exterior branch (35) of the frame, the terminal (33) being able to be attached to the sheet (22*a*) by inserting the connecting bridge (36) into the slot (23), the interior and exterior branches holding the sheet (22*a*), one on each side thereof, and the terminal tip (38) being inserted at the same time into the opening (24), or if applicable, into the auxiliary slot (25).

6. The construction system (1) according to claim 5, wherein the sheet (22*a*) is oriented perpendicular to the direction in which the cross-member (3) extends and the frame is also oriented perpendicular to the direction of extension of the cross-member.

7. The construction system (1) according to claim 3, wherein the second entry part (B) is an opening (24) passing through the sheet (22*a*), the exterior branch (35) of the anchor frame is shorter than the interior branch (34); and the length of the anchoring end (37) is such that the anchoring end passes through the sheet and can provide support for the interior branch (34) of the frame.

8. The construction system (1) according to claim 3, wherein the second entry part (B) is the auxiliary slot (25), the sheet (22*a*) is provided with an adjustment window (26) and the interior branch (34) of the frame with a bend (34*a*) that engages into the adjustment window (26).

9. The construction system (1) according to claim 1, wherein the anchor means (22) comprise a sheet (22*a*), with the first and second entry parts (A, B) formed by two anchor through holes (27, 28).

10. The construction system (1) according to claim 9, wherein the terminal (33), which is bent back onto itself, forms at least two bends (39*a*, 39*b*) that correspond to said openings through the plate, with the terminal able to be aligned on the sheet (22*a*) through the anchor through holes (27, 28).

11. The construction system (1) according to claim 9, wherein the anchor through holes (27, 28) are not coplanar.

12. The construction system (1) according to claim 11, wherein the sheet (22*a*) is oriented perpendicular to the direction of extension of the cross-member (3) and comprises a tab (29) that extends in the direction of the cross-member on which one of the anchor through holes (27) is formed; and the terminal (33) is bent back onto itself in a first bend (a) that orients a first section (41) of the terminal for insertion into the anchor through hole (27); and a second bend (b) determining an anchoring end (37), wherein the terminal tip (38) is positioned, at an angle with the first section of the terminal, and is able to be inserted into the second anchor through hole (28).

13. The construction system (1) according to claim 12, wherein the anchor through hole (27) extends to the edge of the sheet (22*a*), offering a lateral access (27*a*) for the insertion of the terminal (33).

14. The construction system (1) according to claim 1, wherein the anchor means (22) comprise a sheet (22*a*), with the first and second entry parts (A, B) being formed by opposing sides (30*a*, 30*b*) of a through slot (30) formed in said sheet; and the terminal (33) is bent back onto itself, determining a sort of spring with two branches, one interior (41) and one exterior (42), a connecting bridge (43), each branch having an anti-return bend (41*a*, 42*a*) oriented in the direction of the opposite branch, with each aimed at fitting by restoring force in one side (30*a*, 30*b*) of the through slot, requiring the compression of the spring, bringing the branches together and inserting the bridge into the through slot.

* * * * *